US010391501B2

(12) United States Patent
Udy et al.

(10) Patent No.: US 10,391,501 B2
(45) Date of Patent: Aug. 27, 2019

(54) MOVABLE ATTACHMENT FOR ROLLER PRESSES AND A METHOD FOR REMOVING CERTAIN PARTS THEREOF

(71) Applicants: FLSMIDTH A/S, Valby (DK); Roald Sogno, Midvale, UT (US)

(72) Inventors: David Dustin Udy, Layton, UT (US); Roald Sogno, Midvale, UT (US)

(73) Assignee: FLSMIDTH A/S, Valby (DK)

( * ) Notice: Subject to any disclaimer, the term of this patent is extended or adjusted under 35 U.S.C. 154(b) by 343 days.

(21) Appl. No.: 15/503,431

(22) PCT Filed: Sep. 18, 2015

(86) PCT No.: PCT/US2015/050873
§ 371 (c)(1),
(2) Date: Feb. 13, 2017

(87) PCT Pub. No.: WO2016/048814
PCT Pub. Date: Mar. 31, 2016

(65) Prior Publication Data

US 2017/0246639 A1 Aug. 31, 2017

Related U.S. Application Data

(60) Provisional application No. 62/055,142, filed on Sep. 25, 2014.

(51) Int. Cl.
*B30B 3/04* (2006.01)
*B30B 15/04* (2006.01)
(Continued)

(52) U.S. Cl.
CPC ..... *B02C 4/32* (2013.01); *B02C 4/02* (2013.01); *B02C 4/28* (2013.01); *B30B 3/04* (2013.01); *B30B 15/041* (2013.01); *B30B 15/08* (2013.01)

(58) Field of Classification Search
CPC ..... B30B 3/04; B30B 15/08; B30B 15/041; B02C 4/28; B02C 4/02; B02C 4/32
(Continued)

(56) References Cited

U.S. PATENT DOCUMENTS 344,258 A * 6/1886 Dunne ..... B30B 3/04 241/285.1
5,553,796 A * 9/1996 Bettenworth ..... B02C 4/426 241/230
(Continued)

FOREIGN PATENT DOCUMENTS

DE 1100432 B 2/1962
RU 2395379 C1 5/2010
(Continued)

OTHER PUBLICATIONS

International Search Report and Written Opinion dated Dec. 24, 2015, 7 pages.

*Primary Examiner* — Jimmy T Nguyen
(74) *Attorney, Agent, or Firm* — Jeffrey A. Sharp

(57) ABSTRACT

A roller press includes a frame assembly and a force generation device. The force generation device is configured to move so that it is removable when top members of the frame assembly are connected to the side members of the frame assembly and fixed in a closed horizontal position. The connection device for attaching the force generation device to the frame assembly includes a mounting plate and a hinge or sliding device.

3 Claims, 6 Drawing Sheets

(51) Int. Cl.

| | |
|---|---|
| ***B30B 15/08*** | (2006.01) |
| ***B02C 4/32*** | (2006.01) |
| ***B02C 4/02*** | (2006.01) |
| ***B02C 4/28*** | (2006.01) |

(58) Field of Classification Search
USPC ..... 100/155 R, 168, 176
See application file for complete search history.

(56) References Cited

U.S. PATENT DOCUMENTS

| | | | | |
|---|---|---|---|---|
| 7,842,552 | B2 * | 11/2010 | Karidis | H01L 23/053 257/680 |
| 7,896,272 | B2 * | 3/2011 | Frangenberg | B02C 4/28 241/135 |
| 8,297,183 | B2 * | 10/2012 | Horster | B02C 4/02 100/168 |
| 8,795,563 | B2 * | 8/2014 | Splinter | B02C 4/32 100/170 |
| 9,364,834 | B2 * | 6/2016 | Wollenhaupt | B02C 4/02 |

FOREIGN PATENT DOCUMENTS

| | | | |
|---|---|---|---|
| WO | 2006084652 | A1 | 8/2006 |
| WO | 2009071514 | A1 | 6/2009 |

* cited by examiner

MOVABLE ATTACHMENT FOR ROLLER PRESSES AND A METHOD FOR REMOVING CERTAIN PARTS THEREOF

FIELD OF INVENTION

The present invention relates to roller presses and more particularly to a roller press arrangement which more easily allows access to certain parts of the roller press. The present invention additionally relates to a connection device for movably attaching certain parts to the roller press and to a method for more easily performing maintenance on such parts.

BACKGROUND OF THE INVENTION

Different types of roller presses are used in the cement and minerals industries to crush, grind and comminute material. One type of roller press is a High Pressure Grinding Roller (HPGR) system. HPGR technology has traditionally been used in the cement industry for many years and over the past few years HPGR has also proven itself on more complex and harder ores in the mineral industry.

Most generally, in HPGR the feed material is exposed to very high pressures for a short time when it passes through rollers. The high pressure of the rollers causes the formation of micro-cracks and boundary weakening in the feed particles and thus generates a substantial amount of fine material (e.g.—in the form of briquettes or fine dusts). The pressed fine material product from the HPGR can be fed directly to a ball mill which works to further comminute such material. As a significant amount of work has been effected before the ball mill, HPGR makes it possible to increase the throughput of the ball mill and in most cases significantly reduce the specific power consumption of the total milling system.

Roller presses typically include two grinding rollers—for example, a stationary roller and a second moveable roller. The stationary and moveable rollers are spaced apart from each other to define a nip (or gap) between the rollers. The rollers are rotated to comminute material that may pass through the nip. The second moveable roller may be moveable away from the first roller to widen the nip and may be moveable closer to the stationary roller to narrow the nip. Examples of roller presses may be appreciated from U.S. Pat. Nos. 880,035, 4,484,879, 4,838,156, 4,905,910, 5,192,030, 5,211,108 5,354,002, 5,405,091, 5,454,520, 5,505,389, 5,601,242, 5,918,823 and U.S. Patent Application Publication Nos. 2009/0314868 and 2009/0236455.

The grinding rollers are typically driven and controlled by force generation devices. Force generation devices may be any device capable of applying force to the moveable bearing housings (i.e.—the housings which contain the grinding rollers) or directly to the grinding rollers in order to widen or narrow the nip. The force generation devices may further be capable of absorbing forces from the moveable grinding rollers and may be configured to help maintain a resultant width of the nip between the rollers when comminuting crushable material.

For example, force generation devices may be devices such as hydraulic cylinders or rams, springs and the like. By way of further example, FLSmidth's HPGR is typically equipped with a bilateral hydraulic pressing system, which ensures that the pressing force is largely uniform during the comminution process. The system serves to protect the press against localized overloading and stress. The system contains a skew control feature for limiting the grinding gap differential. Components for pressurizing the cylinders are integrally mounted and pre-piped on a common base consisting of a pump (with standby pump), filter, safety and control valves, pressure transmitter, and reservoir. Typically, four double-acting hydraulic cylinders, mounted in pairs are utilized.

However, such force generation devices are typically very heavy and difficult to remove from the HPGR system for maintenance/replacement because such devices sit directly under the top frame of the roller press. As a result of such placement, there is significant downtime on the HPGR system when such force generation devices are required to be maintained or replaced. In addition, such placement results in a removal or repair process which is more dangerous than one that has less restricted access, and auxiliary tools that occupy a significant amount of space. By way of example, in the design of the frame for FLSmidth's HPGR, as illustrated in FIG. 6, before the heavy force generation devices can be hoisted out of the system, the pins of the top member of the frame assembly must be disconnected and thereafter portions of the HPGR must be moved or rotatably dropped to the ground in order to expose the force generation devices. By way of further example, the roller press system disclosed in U.S. Pat. No. 7,451,945 similarly requires pins to be removed from the top member of the frame assembly and for the entire, heavy overhead frame to be rotated into the open position before the force generation devices can be hoisted for replacement or repair. When in the open position, the rotated portion of the frame occupies a significant amount of space next to the HPGR system, can cause safety concerns and takes a great deal of time and wasted energy to rotate into position. Similar examples of such systems are found in DE20207014764, US 2013/025476 and US 2014/048634.

A new roller press is needed that permits the force generation device(s) to be more easily removed for replacement or repair without removing or rotating the top member of the frame assembly. Such a roller press and method for performing maintenance with such a press would result in less operational downtime, higher resultant throughput, safer maintenance conditions and a smaller footprint during such a process, without limitation.

SUMMARY OF THE INVENTION

A roller press is provided comprising a frame assembly and a force generation device. The frame assembly is comprised of one or more top members which are selectively separable from one or more side members which are in turn selectively separable from one or more bottom members. The force generation device is movably attached to one of the side members (3) and the force generation device is configured to move so that it is removable when the top members are connected to the side members and fixed in a closed horizontal position. The force generation device can be movably attached to one or more side members by a mounting plate and a connection device. The connection device can be comprised of a hinge. The hinge can be rotatable about the y-axis or the z-axis. The connection device can also be comprised of a sliding device. The connection device can be slidable in the x-z plane.

A connection device for attaching a force generation device to the frame of a roller press is also provided. The connection device can be comprised of a mounting plate and a hinge. The force generation device can be disposed on the mounting plate and the hinge can be disposed on the mounting plate and movably attached to the frame. The hinge can be rotatable so that the force generation device is removable when a plurality of top members are connected to side members and fixed in a closed horizontal position. The connection device can be rotatable about the y-axis or the z-axis.

The connection device can also be comprised of a mounting plate and a sliding device. The force generation device can be disposed on the mounting plate and the sliding device can be disposed on the mounting plate and movably attached to the frame. The sliding device can be slidable so that the force generation device is removable when a plurality of top members are connected to side members (3) and fixed in a closed horizontal position. The connection device can be slidable in the x-z plane.

Methods for performing maintenance on force generation devices of roller presses are also provided. A first method is comprised of the following steps: moving a force generation device which is movably attached to one or more side members of a frame assembly of the roller press by a mounting plate and a connection device in the x-z plane (12) and removing the force generation device from the roller press when a plurality of top members are connected to side members and fixed in a closed horizontal position. The connection device in the foregoing method can be comprised of a sliding device. A second method is comprised of the following steps: moving a force generation device which is movably attached to one or more of a plurality of side members of a frame assembly of the roller press by a mounting plate and a connection device, about the y-axis or z-axis and removing the force generation device from the roller press when a plurality of top members are connected to side members and fixed in a closed horizontal position. The connection device in the foregoing method can be comprised of a hinge.

BRIEF DESCRIPTION OF THE DRAWINGS

The invention will be described below, with reference to the enclosed drawings wherein.

DETAILED DESCRIPTION OF EXEMPLARY EMBODIMENTS

Figure 1:
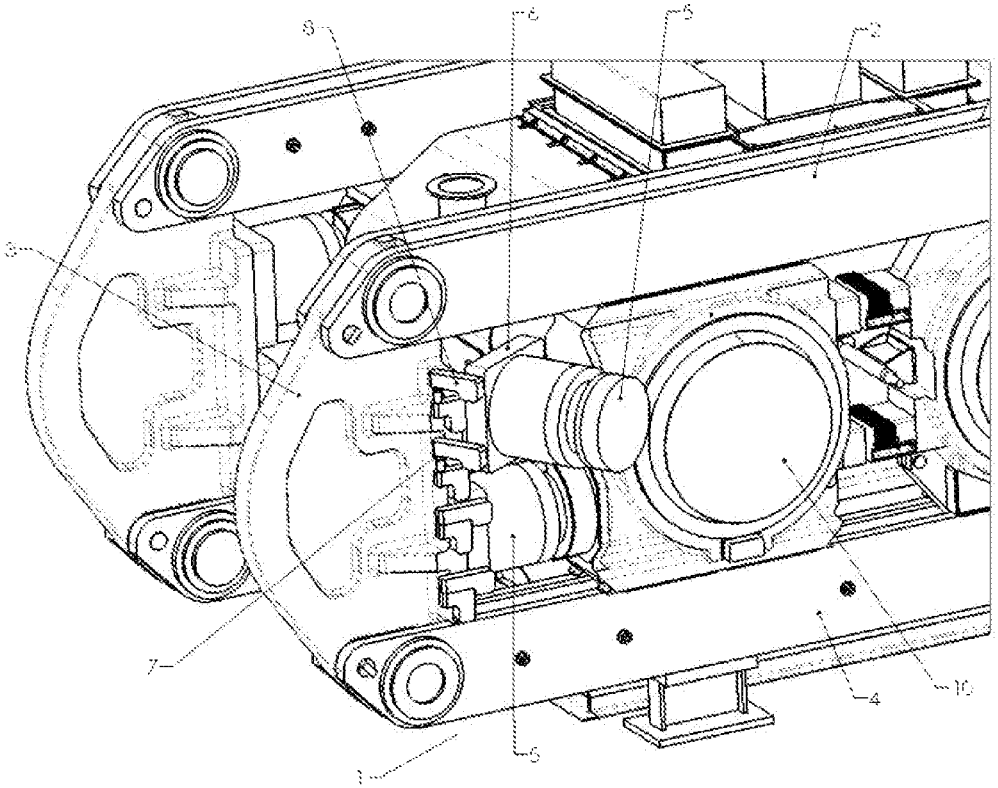
FIG. 1 is a schematic view of a first present embodiment of a roller press according to an embodiment of the invention.
Figure 2:
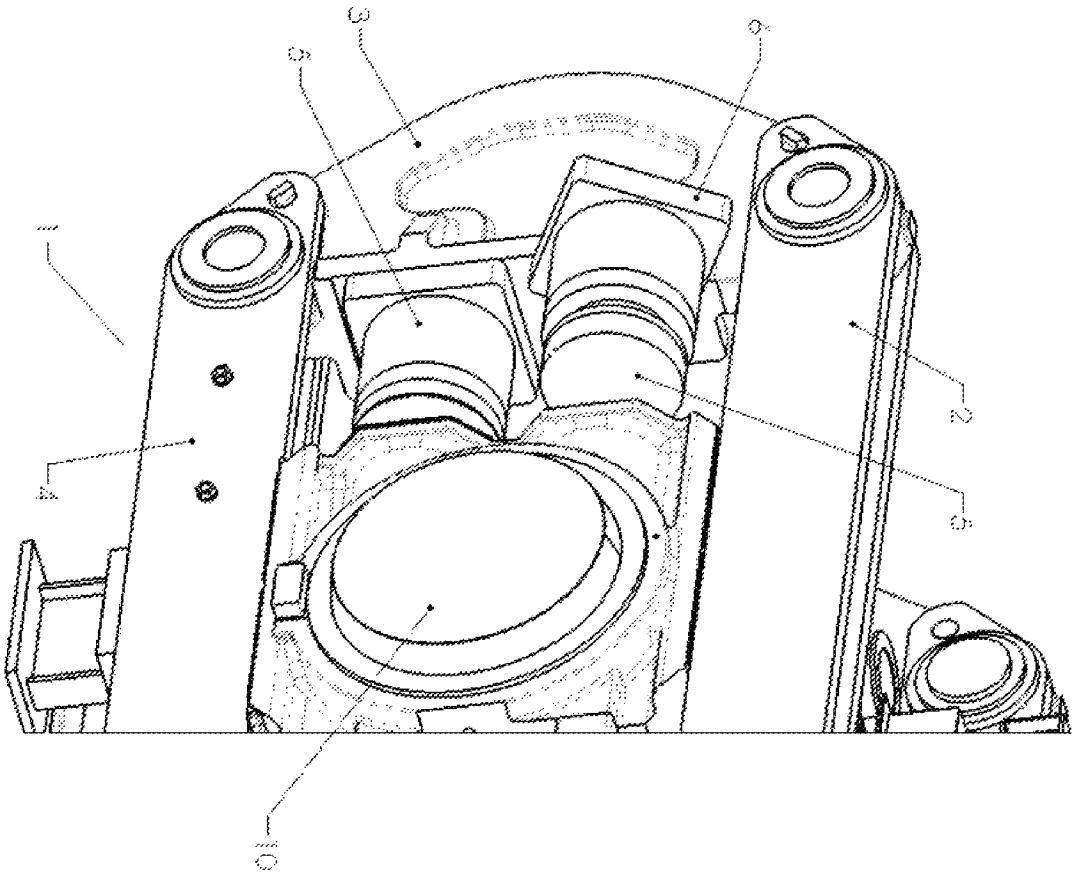
FIG. 2 is a schematic view of a second present embodiment of a roller press according to an embodiment of the invention.
Figure 3:
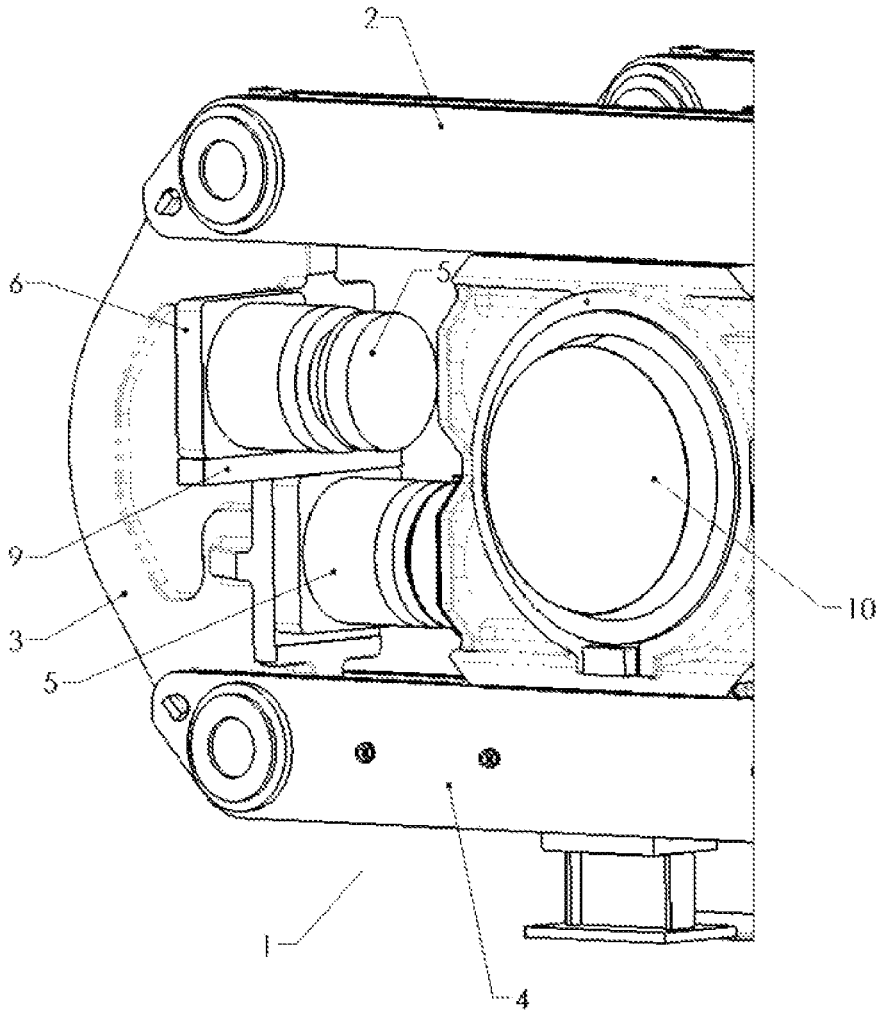
FIG. 3 is a schematic view of a third present embodiment of a roller press according to an embodiment of the invention.
Figure 4:
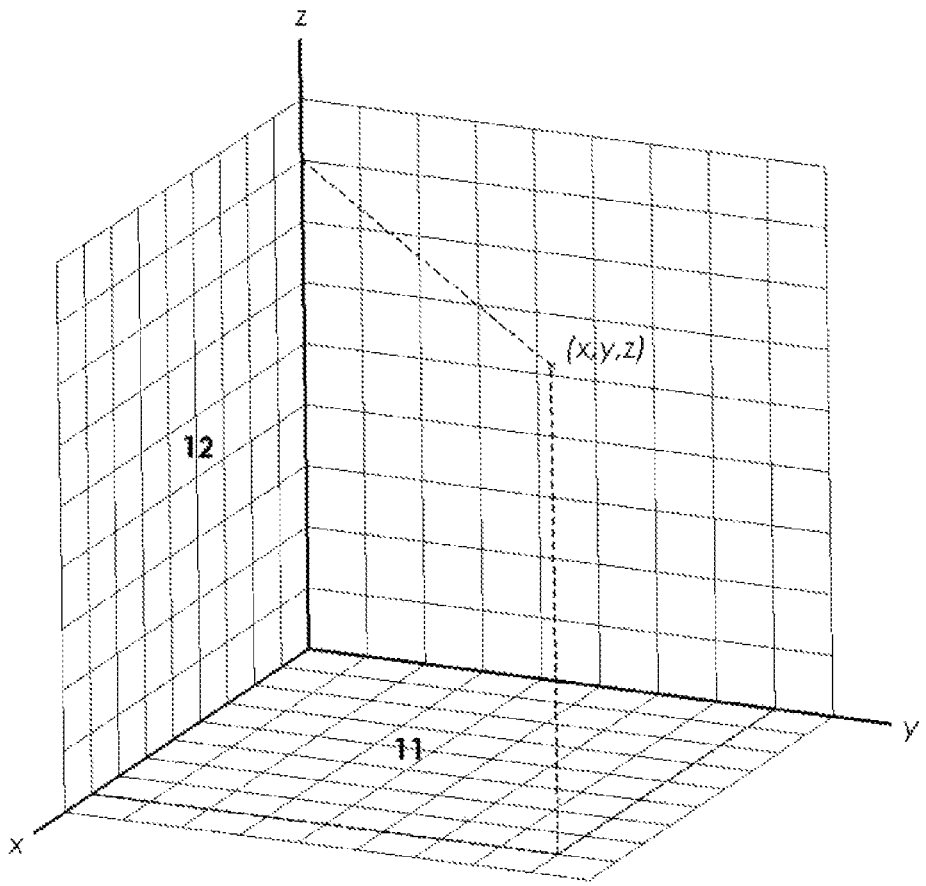
FIG. 4 is a planar view of a Cartesian 3-dimensional coordinate system.

Referring to FIGS. 1-3, a roller press (1) is comprised of a frame assembly comprising one or more of a plurality of top members (2) selectively separable from one or more of a plurality of side members (3) selectively separable from one or more of a plurality of bottom members (4). The top, bottom and side members can be attached to one another using, for example, pins and bushings, bolted connections, and other similar means of mechanical fastening. The roller press (1) is also comprised of one or more of a plurality of force generation devices (5). The force generation device (5) is movably attached to one or more of a plurality of the side members (3), meaning for example, that the force generation device (5) is configured to move so that the force generation device (5) is removable when the plurality of top members (2) are connected to the side members (3) and fixed in a closed horizontal position. When the plurality of side members (3) are connected to the plurality of top members (2) and are fixed in a closed horizontal position the frame assembly together with the pins and bushings are in place.

Figure 5:
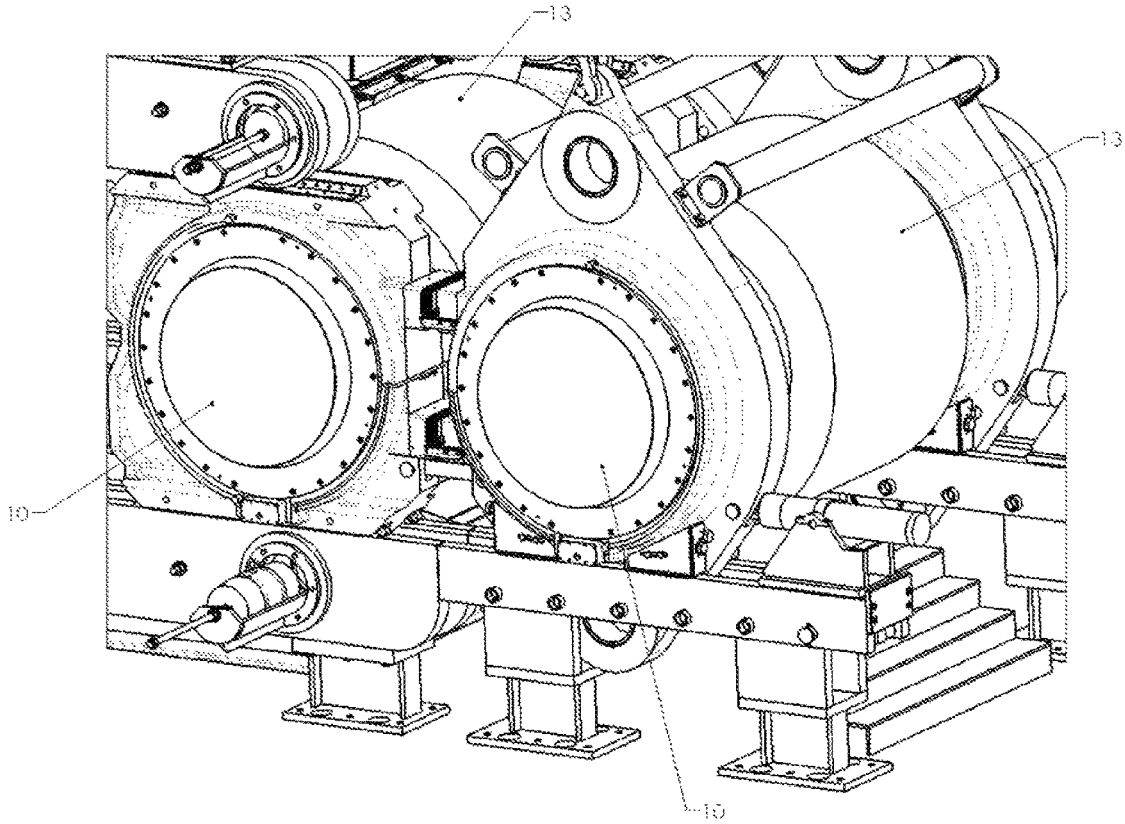
FIG. 5 is an exploded view showing the moveable bearing housings and the grinding rollers of a roller press according to an embodiment of the invention.
Figure 6:
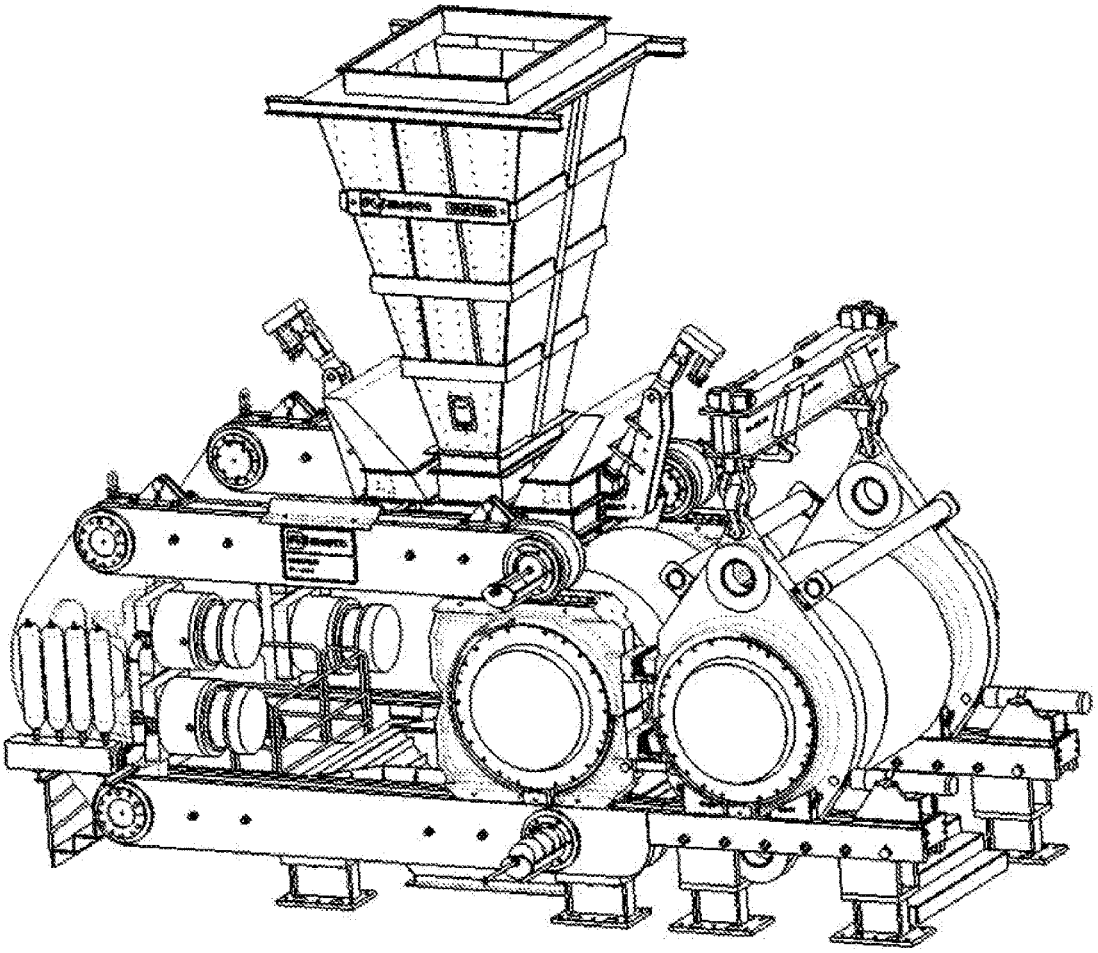
FIG. 6 represents FLSmidth's HPGR frame design wherein the top member of the frame assembly hinders access to the force generation device(s).

Force generation devices (5) may be any devices capable of applying force to the moveable bearing housings (10) (i.e.—the housings which contain the grinding rollers (13)) or to the grinding rollers (13) in order to widen or narrow a nip. (See e.g. FIG. 5). The force generation devices (5) may further be capable of absorbing forces from the grinding rollers (13) and may be configured to help maintain a resultant width of the nip between the grinding rollers (13) when comminuting crushable material. For example, force generation devices (5) may be devices such as hydraulic cylinders or rams, springs and the like. A specific object of the present invention is that the force generation device (5) can be configured to move so that the force generation device (5) is removable when the plurality of top members (3) are connected to the side members (3) and fixed in a closed horizontal position. Such an arrangement, as opposed to the arrangement shown in FIG. 6, permits the force generation device (5) to be more easily accessed for replacement or repair without removing or rotating the entire overhead frame, resulting in less operational downtime, higher throughput, safer maintenance conditions and a smaller footprint during such a process, without limitation.

As further shown in FIGS. 1-3, a force generation device (5) can be movably attached to one or more of a plurality of said side members (3) with a mounting plate (6) and a connection device (7). The mounting plate (6) may be an integral part of the force generation device (5), or may be attached to it by mechanical fastening means. In an exemplary embodiment, the mounting plate (6) is integral to the force generation device (5) and the mounting plate (6) is bolted to the side members (3). In other exemplary embodiments, the mounting plate (6) is bolted, welded or pinned to the force generation device (5) and to the side members (3).

As further shown in FIG. 1, the connection device (7) can be comprised of a hinge (8). The hinge can be made of metal, or like material and can be fastened to the mounting plate (6) by for example, screws, pins or bolts or other similar means of mechanical fastening. The hinge (8) may be rotatable about the z-axis (z), as shown in FIG. 1, or may be rotatable about the y-axis (y), as shown in FIG. 2. Such rotation allows the force generation device (5) to be removed or accessed when the plurality of top members (2) are still connected to side members (3) and fixed in a closed horizontal position. In other embodiments, the hinge (8) can be directly connected to the force generation device (5).

As shown in FIG. 3, the connection device (7) can be comprised of a sliding device (9). The sliding device (9) operates so that the mounting plate (6) holding the force generation device (5) slides so that the force generation device (5) is removable without opening the top member (2) of the frame assembly. For example, the mounting plate (6) can slide in a tongue and groove arrangement or on tracks. As shown in FIG. 3, the sliding device can be slidable in the x-z plane (12).

In other embodiments, the sliding device (9) can be directly connected to the force generation device (5). In some embodiments, the mounting plate (6) can slide on a table-like surface (i.e.—one that is attached to the ground or the side of the machine that is approximately the full length of the force generation device (6)).

Another object of the invention is a connection device (7) for attaching a force generation device (5) to the frame of a roller press comprising a mounting plate (6) and a hinge (8), the force generation device (5) being disposed on the mounting plate (6), the hinge (8) being disposed on the mounting plate (6) and being movably attached to the frame (3); wherein the hinge (8) is rotatable so that the force generation device (5) is removable when a plurality of top members (3) are connected to side members (3) and fixed in a closed horizontal position. As shown in FIGS. 1-2, the hinge (8) may be rotatable about the z-axis (z) and about the y-axis (y). In another embodiment, the hinge (8) can be directly connected to the force generation device (5).

Yet another object of the invention is a connection device (7) for attaching a force generation device (5) to the frame of a roller press comprising: a mounting plate (6) and a sliding device (9), the force generation device (5) being disposed on the mounting plate (6), the sliding device (9) being disposed on the mounting plate (6) and being movably attached to the frame (3); wherein the sliding device (9) is slidable so that the force generation device (5) is removable when a plurality of top members (3) are connected to side members (3) and fixed in a closed horizontal position. As shown in FIG. 3, the sliding device (9) can be slid in the x-z plane (12). In another embodiment, the sliding device (9) can be directly connected to the force generation device (5).

Also provided is a method for performing maintenance on a force generation device (5) of a roller press (1) comprising the steps of: moving a force generation device (5) movably attached to one or more of a plurality of side members (3) of a frame assembly of a roller press, in the x-z plane (12) or about the y-axis (y) or z-axis; removing the force generation device (5) from the roller press (1) when a plurality of top members (3) are connected to side members (3) and fixed in a closed horizontal position. In some embodiments, the force generation device (5) is movably attached to one or more of a plurality of side members (3) of a frame assembly of a roller press by a mounting plate (6) and a connection device (7). In an exemplary embodiment the connection device is comprised of a hinge (8). In another exemplary embodiment the connection device is comprises of a sliding device (9).

While certain present exemplary embodiments of the apparatus and certain embodiments of methods of practicing the same have been shown and described, it is to be distinctly understood that the invention is not limited thereto but may be otherwise variously embodied and practiced within the scope of the following claims.

| LIST OF REFERENCE IDENTIFIERS | |
|---|---|
| 1 | roller press |
| 2 | top member |
| 3 | side member |
| 4 | bottom member |
| 5 | force generation device |
| 6 | mounting plate |
| 7 | connection device |
| 8 | hinge |
| 9 | sliding device |
| 10 | moveable bearing housing |

-continued

| LIST OF REFERENCE IDENTIFIERS | |
|---|---|
| 11 | x-y plane |
| 12 | x-z plane |
| 13 | grinding roller |
| y | y-axis |
| z | z-axis |

What is claimed is:

1. A roller press (1) comprising:

a movable bearing housing (10);

a grinding roller (13);

a frame assembly comprising one or more of a plurality of top members (2) selectively separable from one or more of a plurality of side members (3) selectively separable from one or more of a plurality of bottom members (4); the one or more of a plurality of side members (3) extending in a z-axis (z) direction; the one or more of a plurality of top members (2) and the one or more of a plurality of bottom members (4) extending in a y-axis (y) direction which is perpendicular to the z-axis (z) direction; and a force generation device (5) configured to apply force to the movable bearing housing (10) and being movably attached at one end of its two ends to the one or more of a plurality of said side members (3) by a mounting plate (6) and a connection device (7), and the other end of the two ends is a free end for sliding in relative to the movable bearing housing in an x-axis (x) direction;

wherein said force generation device (5) is configured to rotate or slide with respect to the frame assembly in the x-axis (x) direction which is perpendicular to both the z-axis (z) and the y-axis (y) directions so that said force generation device (5) is removable from the frame assembly when said plurality of top members (3) are connected to said side members (3) and fixed in a closed horizontal position;

wherein said connection device (7) comprises a hinge (8) that is rotatable about the y-axis (y) or rotatable about the z-axis (z), or wherein said connection device (7) comprises a sliding device that is slidable in an x-z plane (12) defined by the x-axis (x) and z-axis (z) directions.

2. A method for performing maintenance on a force generation device (5), wherein said force generation device (5) is configured to apply force to a movable bearing housing (10) of a roller press (1), the method comprising the steps of:

moving a force generation device (5), such that the force generation device (5) slides with respect to a frame assembly of the roller press (1), in an x-z plane (12) defined by an x-axis (x) and z-axis (z) which are perpendicular to a y-axis (y); said force generation device (5) being movably attached at one end of its two ends to one or more of a plurality of side members (3) of the frame assembly of said roller press (1) by a mounting plate (6) and a connection device (7), and the other end of the two ends is a free end for sliding in relative to the movable bearing housing in an x-axis (x) direction; the force generation device (5) moving in the x-axis (x) direction as it slides relative to the frame assembly of the roller press (1);

removing said force generation device (5) from said roller press (1) when a plurality of top members (2) are connected to the side members (3) and fixed in a closed horizontal position;

wherein said connection device comprises a sliding device (9);

wherein the top members (2) extend in a y-axis (y) direction; and, wherein the side members (3) extend in a z-axis (z) direction.

3. A method for performing maintenance on a force generation device (5), wherein said force generation device (5) is configured to apply force to a movable bearing housing (10) of a roller press (1), the method comprising the steps of:

moving a force generation device (5), such that the force generation device (5) rotates with respect to a frame assembly of the roller press (1), about a y-axis (y) or about a z-axis (z) which are perpendicular to each other and which are each perpendicular to an x-axis (x); said force generation device (5) being movably attached at one end of its two ends to one or more of a plurality of side members (3) of the frame assembly of said roller press (1) by a mounting plate (6) and a connection device (7), and the other end of the two ends is a free end for sliding in relative to the movable bearing housing in an x-axis (x) direction; the force generation device (5) moving in the x-axis (x) direction as it rotates relative to the frame assembly of the roller press (1);

removing said force generation device (5) from said roller press (1) when a plurality of top members (2) are connected to the side members (3) and fixed in a closed horizontal position;

wherein said connection device comprises a hinge (8);

wherein the top members (2) extend in a y-axis (y) direction; and, wherein the side members (3) extend in a z-axis (z) direction.

* * * * *